United States Patent [19]

Clark et al.

[11] 4,350,404

[45] Sep. 21, 1982

[54] ELECTRICAL CONNECTOR CONSTRUCTION

[75] Inventors: William C. Clark; Clifford L. Winings, both of Lee's Summit, Mo.

[73] Assignee: Bell Telephone Laboratories, Incorporated, Murray Hill, N.J.

[21] Appl. No.: 190,370

[22] Filed: Sep. 24, 1980

[51] Int. Cl.[3] ..... H01R 4/02

[52] U.S. Cl. ..... 339/97 R; 339/99 R

[58] Field of Search ..... 339/97 R, 97 P, 98, 339/99 R

[56] References Cited

U.S. PATENT DOCUMENTS

| | | | |
|---|---|---|---|
| 3,824,530 | 7/1974 | Roberts et al. | 339/99 R |
| 4,040,704 | 8/1977 | Huber | 339/99 R |
| 4,040,705 | 8/1977 | Huber | 339/99 R |
| 4,046,446 | 9/1977 | Reavis | 339/99 R |
| 4,062,616 | 12/1977 | Shaffer et al. | 339/99 R |
| 4,066,316 | 1/1978 | Rollings | 339/91 R |
| 4,312,556 | 1/1982 | Dufau | 339/97 R X |

FOREIGN PATENT DOCUMENTS

| | | | |
|---|---|---|---|
| 1483981 | 8/1977 | United Kingdom | 339/97 R |

*Primary Examiner*—Joseph H. McGlynn
*Assistant Examiner*—Frank H. McKenzie, Jr.
*Attorney, Agent, or Firm*—W. H. Kamstra

[57] ABSTRACT

An electrical connector (10) for terminating pairs of conductors (27, 28) on individual single electrical, insulation piercing contacts (14). The connector (10) is formed as two housing halves (11, 12) fitted to a central spacer member (13) to which both are locked. The contacts (14) are mounted in the housing halves (11, 12) and each presents at one end a conventional terminal pin receptacle comprising a pair of opposing blades (15, 16). Toward its other end each contact (14) is formed to present a pair of inverted "U" shaped members (18, 19) which are slotted to accomplish the conductor insulation piercing function. The members (18, 19), although equally spaced on the contacts (14), are staggered in their positions on the contacts (14) with respect to both adjacent contacts within a housing half (11, 12) and adjacent contacts between the housing halves (11, 12). As a result, when the latter elements are assembled, an insulation piercing member (18) of one housing half (11) will extend between the pair of members (18, 19) of the other housing half (12).

7 Claims, 7 Drawing Figures

14
3
4
11
12
13
15
16
17
18
19
20
21
22
23
24
25
27

ELECTRICAL CONNECTOR CONSTRUCTION

TECHNICAL FIELD

This invention relates to electrical connector constructions and more particularly to such constructions adapted to facilitate the connection of multiconductor cables to corresponding connector contact terminals.

BACKGROUND OF THE INVENTION

Electrical connector arrangements for interconnecting the conductors of a multiple conductor cable and the like with the terminal pins of a backplane or other electrical components are well known in the art. One such connector arrangement, for example, is described in the U.S. Pat. of R. W. Rollings, No. 4,066,316, issued Jan. 3, 1978, which connector employs as its basic circuit completion element an electrical contact which at one end provides for the piercing of the conductor insulation to reach the conductor. At its other end, the contact has formed thereon a pair of opposing spring blades which present a receptacle for a terminal pin, the blades clasping the pin by opposing spring action when inserted therebetween. Banks of the contacts are fitted into rectangular cavities or slots provided therefor in an insulative housing, the front face of which presents corresponding banks of funnel-like capture cones for facilitating the entry of a corresponding array of terminal pins into the contact receptacles.

A number of insulation piercing contact terminations for connectors are also known in the art; either for terminating single conductors or a pair of conductors. Thus, for example, a slotted inverted "U" shaped termination for two conductors is taught in the patent of R. P. Reavis, Jr., U.S. Pat. No. 4,046,446 issued Sept. 6, 1977. The base and both legs of the "U" are slotted, the slot of one leg having its insulation piercing blades of the slot at the base of the "U", the slot of the other leg having its insulation piercing blades at the opposite end. Two conductors may thus be terminated, one in each leg of the "U" shaped member as the conductor pair is forced into the slots, the conductors lying one above the other. The legs of the "U" member must thus of necessity be longer than in the case of the termination of a single conductor at the slot blades. In many applications, this extended height would not be important. Thus, were the connector designed to interconnect its conductors at one end with a single isolated row of terminal pins at its other end, the dimensions of the insulation piercing contact and, hence, those of the connector housing, could readily be accommodated.

The electrical connector of the character here contemplated, however, is intended to interconnect with large fields of backplane terminal pins closely spaced, typically on 0.125 inch centers. The connector housing having, for example, double tiers of contacts, must then not only accommodate the tiers of contacts, but must have external dimensions sufficiently narrow in lateral profile to permit the adjacent interconnection of similar connectors, above and below, with the backplane pins. Another, equally important consideration in the achievement of a suitable connector, is its ease of fabrication and assembly. To simplify the assembly, prior art connectors have generally been constructed in several parts. One insulative part typically provides for the arranging and sorting of the multiple conductors and for maintaining them in place. The parts of the housing proper and their fitting together may interact to cause, in some connectors, the insulation piercing action of the connector contact blades. It will be appreciated that, in order to achieve a reliable connector assembly, the circuit completion elements of the insulative subassemblies must be accurately mated to ensure positive electrical connections and, further, once so mated, the subassemblies must be securely locked together to prevent any loosening of the connections as the result of manual movement of the connector, vibration, or temperature changes, for example. At the same time, the connector assembly must provide for the ready separation of the insulative members in order to permit wiring changes and the repair of electrical connections should this eventually prove necessary.

Accordingly, the problem to which the invention is chiefly directed is that of achieving a readily assembled electrical connector construction which provides for the connection of a pair of conductors to each of its contacts and which at the same time is compact and presents an extremely small profile.

SUMMARY OF THE INVENTION

The objectives of the invention are realized in one illustrative connector for terminating pairs of conductors on respective individual, insulation piercing contacts which connector comprises a pair of opposing, insulative housing halves in each of which a row of the contacts are mounted. Each of the contacts, in addition to a termination at one end of a conventional terminal pin receptacle, is provided toward its other end with a pair of inverted "U" shaped insulation piercing members formed in the flat strip of the contact. The members are slotted along the longitudinal axis of the strip, the slots being dimensioned to freely admit a conductor and its insulation along the entire length of the slot in one leg of each of the pair of members of a contact. The slot of the other leg of each of the members is dimensioned to pierce the insulation of a conductor when fitted therein. After the pairs of conductors of the cables have been arranged and fitted in their respective contacts in each of the housing halves, the latter are fitted on each side of an insulative spacer member and locked thereto by detents projecting from the spacer on each side and along its opposite edges. The detents engage shouldered slots provided therefor in the housing halves. Advantageously, the compactness of the connector assembly is achieved by the staggered spacing of the insulation piercing members of the contacts with respect to both adjacent contacts of a housing half and between the contacts of the housing halves. As a result, as the latter are oppositely fitted, at each pair of opposing contacts of the housing halves, an insulation piercing member of one will extend between the pair of members of the other.

BRIEF DESCRIPTION OF THE DRAWING

The features of an electrical connector construction according to the invention will be better understood from a consideration of the detailed description of the organization of one illustrative embodiment thereof which follows when taken in conjunction with the accompanying drawing in which.

DETAILED DESCRIPTION

Figure 1:
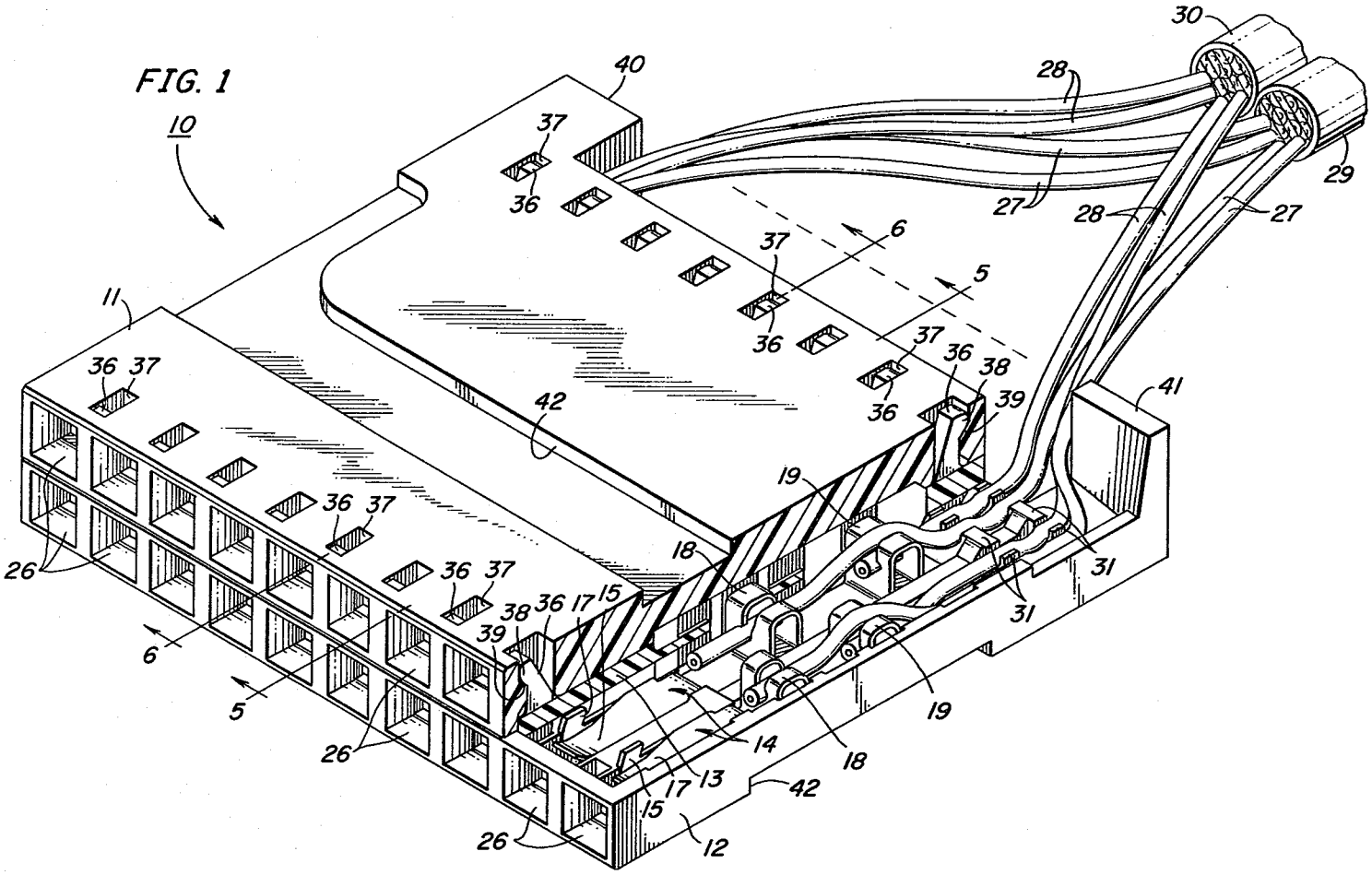
FIG. 1 is an enlarged three-quarter perspective view of a connector construction of the invention with a portion broken away to show the details of the contact arrangement.
Figures 2, 3, 4, 7:
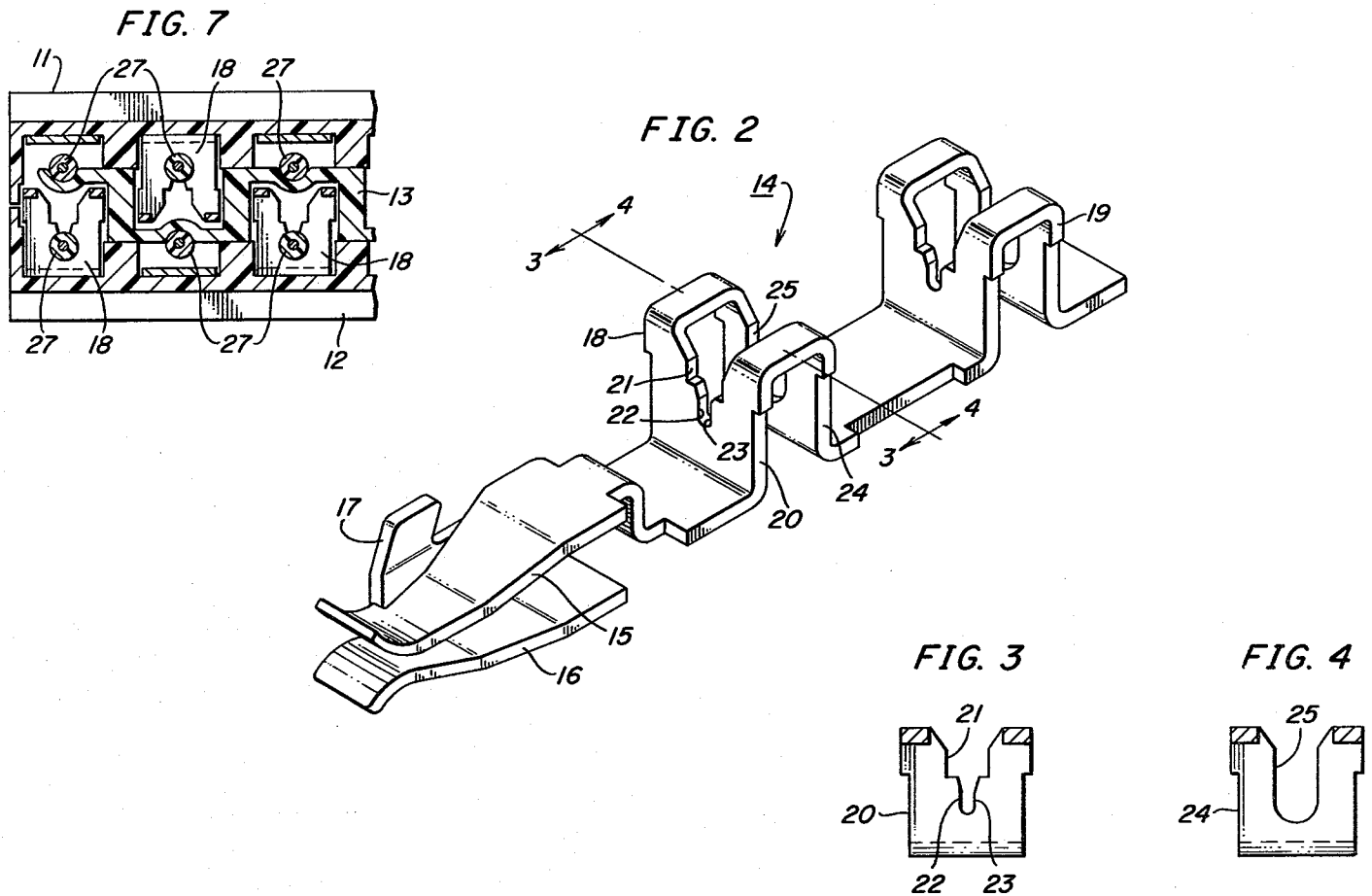
FIG. 2 is an enlarged perspective view of one electrical contact of the character employed in the connector construction of the invention.
FIG. 3 is a sectional view of the contact depicted in FIG. 2 taken along the line 3—3 in the direction indicated.
FIG. 4 is another sectional view of the contact depicted in FIG. 2 taken along the line 4–4 in the direction indicated.
FIG. 7 is a partial sectional view of the connector construction depicted in FIG. 5 taken along the line 7—7.

As shown in FIG. 1 and variously in FIGS. 2 through 4, a connector 10 according to the invention comprises a pair of housing halves 11 and 12 fitted on opposite sides of a central spacer member 13. The housing halves 11 and 12, which may be molded or otherwise formed of any suitable insulative material, are each contoured on its inner face to provide for the snap-in fitting of a plurality of electrical contacts 14 of the character shown in FIG. 2. Each of the contacts 14 is stamped or otherwise formed of an electrically conductive blank to present at one end a pair of opposing blades 15 and 16 which after gradually sloping toward each other, flare slightly outwardly to form a receptacle for the admission of a terminal pin not shown. A side "T" flange 17 is also provided for ensuring the accurate alignment of the contact within a housing half. Toward the other end, contact 14 is formed to present a pair of identical inverted "U" shaped members 18 and 19. The legs and top of each member 18 and 19 are slotted along the longitudinal axis of contact 14 in the manner depicted in FIGS. 3 and 4. Thus, for example, leg 20 of member 18 (FIG. 3) is slotted to taper from its top for a portion of its length to a slot 21 dimensioned sufficiently wide to freely admit an insulated conductor of the gauge with which the connector is adapted for use. The final length of the slot is dimensioned to present a pair of insulation piercing blades 22 and 23. The other leg 24 is slotted to taper from its top to a slot 25 which is dimensioned for its entire length sufficiently wide to freely admit the aforementioned insulated conductor.

Figure 5:
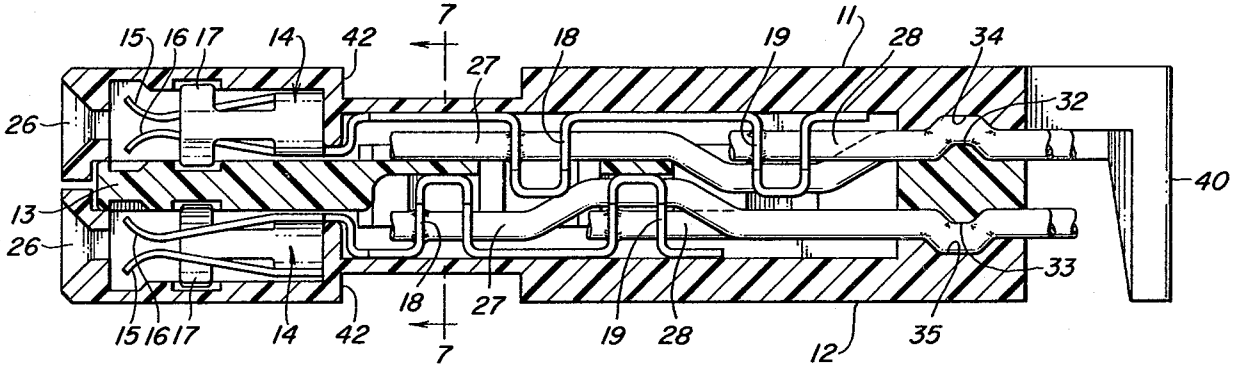
FIG. 5 is a sectional view of the construction of FIG. 1 taken along the line 5—5.

As shown in FIG. 1 with respect to the visible contacts mounted on the housing half 12, members 18 and 19 of each of the contacts, although identical and equally separated, are staggered both with respect to their positions on adjacent contacts within the housing halves and between the housing halves for purposes which will become clear from a consideration of the sectional view of FIG. 5 hereinafter. Both housing halves 11 and 12 present funnel-like capture cones 26 at one end to facilitate the entrance of terminal pins, not shown, into the receptacle ends of the contacts within. Before the housing elements of the connector so far described are assembled, each of the contacts of both housing halves 11 and 12 has fitted in its members 18 and 19 a conductor 27 and 28 of a pair of cables 29 and 30, respectively. The arrangement of conductors and contacts is shown in connection with represented ones of those elements in the housing half 12 in FIG. 1. When so fitted, housing halves 11 and 12 are oppositely mounted on central spacer member 13 to form a unitary assembly as depicted in the section view of FIG. 5 taken along a plane intersecting a pair of opposing contacts on line 5—5 of FIG. 1. A conductor 28 is terminated directly on a first insulation piercing member 19 of a contact 14; a conductor 27 is laid over a conductor 28 in the wide portion of slot 21 of insulation piercing member 19 and is extended for termination in member 18 of a contact 14. The staggered arrangement of members 18 and 19 permits one member of a contact of one housing half to extend between the members 18 and 19 of a contact 14 of the other housing half as demonstrated by member 18 of housing half 11. This arrangement advantageously achieves an optimum flat profile of the connector assembly. As seen in FIG. 5, spacer member 13 is suitably apertured and contoured on either side to accommodate contacts 14 and to provide guides and supports 31 for the conductors (FIG. 1). Conductor strain relief is provided by protrusions 32 and 33 which together with indentations 34 and 35 in housing halves 11 and 12 present slight diversions in the conductor channels.

Figure 6:
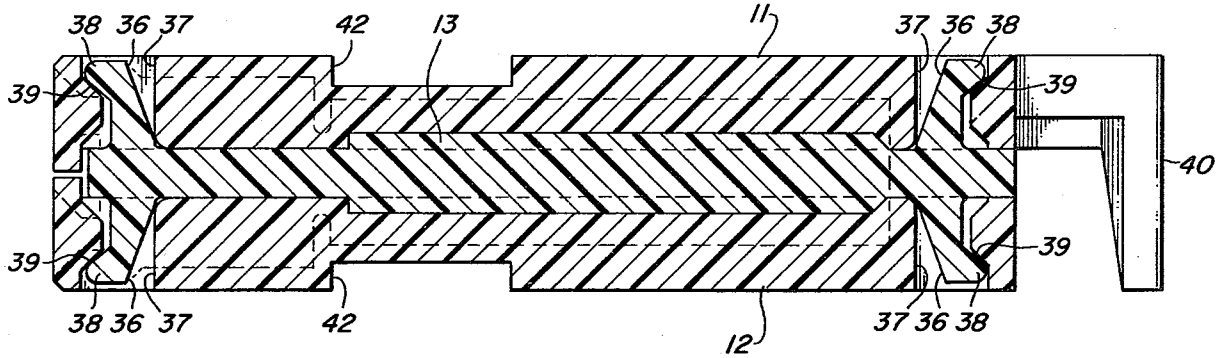
FIG. 6 is a sectional view of the construction of FIG. 1 taken along the line 6—6.

As more clearly seen in the section view of FIG. 6 taken along a plane intersecting the assembly between contacts on line 6—6 of FIG. 1, housing halves 11 and 12 are locked to central spacer member 13 by a plurality of detents 36 extending from opposite sides of spacer 13 at opposite edges. Each of the housing halves 11 and 12 have corresponding slots 37 into which detents 36 extend when the housing elements are assembled. A snap-together lock of the latter elements is achieved by nodes 38 formed at the ends of detents 36, which nodes 38 are urged into engagement with shoulders 39 provided in slots 37 when detents 36 are forced into the slots. In one illustrative embodiment of a connector according to the invention, end tabs 40 and 41 are provided on housing halves 11 and 12 on which connector identification indicia may be affixed. The conductor support contours of central space member 13 are shown in the partial section view of FIG. 7, only conductors 27 extending farthest inward being visible. Finally, both housing halves 11 and 12 may be provided with recesses 42 in their outer surfaces which may be employed in cooperation with locking mechanisms, not shown, for locking the connector assembly in place on the backplane terminal pins.

What has been described is considered to be only one illustrative connector construction according to the principles of the invention and it is to be understood that various and numerous other arrangements may be devised by one skilled in the art without departing from the spirit and scope of the invention as limited only by the accompanying claims.

What is claimed is:

1. An electrical connector construction comprising a first and a second partial housing (11, 12) each having a base and an open side, a plurality of contact elements (14) fitted on said base of each of said partial housings (11, 12) each of said contact elements (14) having means (15, 16) at one end for engaging electrical terminations of other connector arrangements and extending to the other end to present conductor insulation piercing means characterized in that said insulation piercing means comprises at least one blade means (20) extending outwardly from a housing (11, 12) base, each of said blade means (20) having a slot (22) parallel to the longitudinal axis of said contact (14) for engaging, respectively, an electrical conductor (27), and in that said blade means (20) is arranged on said contacts (14) in each of said partial housings (11, 12) so that when said housings (11, 12) are fitted together open sides facing, a blade means (20) of one housing (11) will extend beyond the end of the blade means (20) of the other housing (12).

2. An electrical connector construction comprising a first and a second partial housing (11, 12) each having a base and an open side, a plurality of contact elements (14) fitted on said base of each of said partial housings (11, 12), each of said contact elements (14) having means (15, 16) at one end for engaging electrical terminations of other connector arrangements and extending to the other end to present conductor insulation piercing means characterized in that said insulation piercing means comprises a pair of blade means (18, 19) extending outwardly from a housing (11, 12) base, each of said blade means having slots (22, 23) parallel to the longitudinal axis of said contact (14) for engaging, respectively, a pair of electrical conductors (27, 28), and in that said blade means (18, 19) are arranged on said contacts (14) in each of said partial housings (11, 12) so that when said housings (11, 12) are fitted together open sides facing, a blade means (18) of one housing (11) will extend between the pair of blade means (18, 19) of the other housing (12).

3. An electrical connector construction comprising a first and a second partial housing (11, 12) each having a base and an open side, a plurality of contact elements (14) fitted on said base of each of said partial housings (11, 12), each of said contact elements (14) having means (15, 16) at one end for engaging electrical terminations of other connector arrangements and extending to the other end to present conductor insulation piercing means characterized in that said insulation piercing means comprises a pair of inverted, substantially "U" shaped members (18, 19) extending outwardly from a housing (11, 12) base, each of said members having slots (22, 23) parallel to the longitudinal axis of said contact (14) for engaging, respectively, a pair of electrical conductors (27, 28), and in that said members (18, 19) are arranged on said contacts (14) in each of said partial housings (11, 12) so that when said housings (11, 12) are fitted together open sides facing, a member (18) of one housing (11) will extend between the pair of members (18, 19) of the other housing (12).

4. An electrical connector construction as claimed in claim 1, 2, or 3 further characterized in that a central spacer member (13) is provided between said partial housings (11, 12) said spacer member (13) having surfaces contoured and apertured to arrange and support said conductors (27, 28).

5. An electrical connector construction as claimed in claim 4 further characterized in that locking means (36, 38, 39) are provided for locking said partial housings (11, 12) together and to said central spacer member (13).

6. An electrical connector construction as claimed in claim 5 further characterized in that said locking means comprises a first and a second plurality of detents (36) extending from opposite sides of said central spacer member (13) at respective opposite edges thereof, and a first and second plurality of slots (37) at opposite edges of each of said partial housings (11, 12) corresponding to said first and second plurality of detents (36), said slots (37) having shoulders (39) adapted to retain said detents (36).

7. An electrical connector construction as claimed in claim 6 further characterized in conductor strain relief means comprising protuberances (32, 33) extending from said central spacer member (13) and corresponding indentations (34, 35) in said partial housings (11, 12) for clasping said conductors (27, 28) therebetween.

* * * * *